United States Patent [19]

Chabala et al.

[11] Patent Number: 4,654,489

[45] Date of Patent: Mar. 31, 1987

[54] INSULATING SUPPORT COLUMN WITH OPERATING MEMBER

[75] Inventors: Leonard V. Chabala, Maywood; Christopher D. Roman, Glenview, both of Ill.

[73] Assignee: S&C Electric Company, Chicago, Ill.

[21] Appl. No.: 781,389

[22] Filed: Sep. 27, 1985

Related U.S. Application Data

[63] Continuation-in-part of Ser. No. 721,616, Apr. 10, 1985, Pat. No. 4,596,906.

[51] Int. Cl.[4] ..... H01H 31/00

[52] U.S. Cl. ..... 200/48 R; 200/144 R; 200/48 V

[58] Field of Search ..... 200/48 R, 48 A, 48 V, 200/48 KB, 48 P, 144 R

[56] References Cited

U.S. PATENT DOCUMENTS

| | | | |
|---|---|---|---|
| 2,306,186 | 12/1942 | Rankin | 200/48 R |
| 2,872,550 | 2/1959 | Schwager | 200/48 R |
| 3,333,071 | 7/1967 | Oppel et al. | 200/48 R |
| 3,508,022 | 4/1970 | Chabala | 200/146 R |
| 3,566,055 | 2/1971 | Weston | 200/48 R |
| 3,696,729 | 10/1972 | Chabala et al. | 98/1 |
| 3,813,504 | 5/1974 | Anderson | 200/48 R |
| 4,596,906 | 6/1986 | Chabala et al. | 200/48 R |

OTHER PUBLICATIONS

"HGF 100 $SF_6$ Outdoor Circuit Breaker Series", Sprecher & Schuh, Publication No. 42 F1 (pp. 1–2).

"HP506—A New Efficient Circuit Breaker for Distribution Switchgear", Sprecher & Schuh, Publication No. 41F5 (pp. 1–2).

"Low Oil Content Circuit Breaker for 52 . . . 72.5lV Indoor Installations", Sprecher & Schuh, Publication No. 4120 (pp. 1 and 3).

"Low Oil Content Circuit Breaker for Outdoor Stations 10 . . . 82.5kV" Sprecher & Schuh, Publication No. 4150, Dec. 1977 (pp. 1 and 3).

Sprecher News, Mar. 1980 (pp. 1 and 11).

"$SF_6$ Circuit Breaker Type HPL", ASEA, Pamphlet No. LA 36-102E (pp. 1–4).

"$SF_6$ Circuit-Breakers for Rated Voltages of 72.5lV up to 765lV", AEG brochure (pp. 1, 6, 7, and 11).

"$SF_6$ Circuit-Breakers Type ELF and Type ELI", BBC Brown, Boveri & Company Publication No. CH-A-083 (pp. 1, 4, 5, 7, and 12).

IEEE paper C 74 170-7.

*Primary Examiner*—Stephen Marcus
*Assistant Examiner*—Ernest G. Cusick
*Attorney, Agent, or Firm*—James V. Lapacek

[57] ABSTRACT

An insulating support column is provided for driving interrupting units and includes an insulator having a longitudinal bore extending therethrough, a translational operating member extending through and outside of both ends of the insulator, and sealing arrangements between the operating member and the insulator to retain insulating material within the insulator and to seal the bore from the external environment. The insulating support column is disposed substantially vertically during operation to drive the interrupting unit. The operating member includes a first portion of insulative material and metallic portions that are affixed at each end of the first portion. The lower metallic end portion of the operating member includes a connector that is driven by a power train and the upper metallic end portion includes a connector that is connected to drive an interrupting unit. An end fitting is affixed to each end of the insulator. Each of the end fittings includes a central bore and a sealing arrangement within the bore. The upper sealing arrangement operates with respect to the first, insulative portion of the operating member and the lower sealing arrangement operates with respect to the lower metallic portion. The lower sealing arrangement is arranged with respect to the mounting surface such that the lower metallic end portion of the operating member does not extend into the insulator beyond the end fitting. The dielectric withstand capability of the insulating support column is not reduced by the presence of the operating member for any position of the operating member along its translational path. Accordingly, if excessive voltage should cause an electrical discharge to occur between the end fittings of the insulator, the flashover will take place external to the insulator.

13 Claims, 5 Drawing Figures

143
36
24
20
32
140
142
141
145
160
19
22
26
144
161
150
114
152
48
34
133
P
132
131
134
D3
D2
D1
123
120
121
124
h
P1
122
18

INSULATING SUPPORT COLUMN WITH OPERATING MEMBER

CROSS REFERENCE TO RELATED APPLICATIONS

This application is a continuation-in-part application of application Ser. No. 721,616 and is directed to an improved insulating support column including a translational operating member disposed therethrough as disclosed in co-pending, commonly-assigned U.S. application Ser. Nos. 721,614, 721,615, and 721,616, now U.S. Pat. No. 4,596,906, filed on Apr. 10, 1985 in the names of L. V. Chabala et al.

BACKGROUND OF THE INVENTION

1. Field of the Invention

The present invention relates generally to the field of insulating support columns for driving interrupting units of high voltage circuit protection arrangements and more particularly to an improved insulating support column including a translational operating member that extends axially through and outside of both ends of the insulating support column.

2. Description of the Related Art

Various drive linkage arrangements are known for high-voltage circuit breakers and for high-voltage interrupting units. One category of drive linkage arrangement include insulating columns with pressurized gas or oil that carry translational operating members that are driven in various manners; commonly by pivotal linkage members that enter the sealed, insulated column through an "O" ring seal or the like. Other types of drive linkage arrangements in this category can be described as using a crank with a rotary shaft seal; for example as shown in Sprecher & Schuh publications 42F1 entitled "HGF 100 $SF_6$ Outdoor Circuit Breaker Series", 41F5 entitled "HP506-A New Efficient Circuit Breaker for Distribution Switchgear", 4120 entitled "Low Oil Content Circuit Breaker for 52 . . . 72.5 kV Indoor Installation" (October 1975), 4150 entitled "Low Oil Content Circuit Breaker for Outdoor Stations 10 . . . 82.5 kV" (December 1977), and *Sprecher News,* March 1980. Another type of drive linkage arrangement in this category utilizes a pneumatically- or mechanically-driven operating rod that extends into a pressurized column; seals being provided between the translational operating rod and the pressurized column. Arrangements of this type are shown in ASEA Pamphlet LA36-102E entitled "$SF_6$ Circuit-Breaker Type HPL", AEG brochure entitled "$SF_6$ Circuit-Breaker for Rated Voltages of 72.5 kV up to 765 kV", and BBC Brown, Boveri & Company Publication No. CH-A083 322 E entitled "$SF_6$ Circuit-Breaker Type ELF and Type ELI".

Another drive linkage arrangement described in U.S. Pat. No. 3,566,055 and IEEE paper C 74 170-7 provides for rotation of an insulator 31 (FIGS. 3 and 4) to operate a T-shaped movable switch component 30. The drive linkage arrangement also provides for rotation of an insulated rotary shaft 51 (FIGS. 5 and 8–11) that extends upwardly through the insulator 31 into the center section 33. The rotation of the insulated shaft 51 operates mechansims that in turn operate the interrupting device 40 and a bypass device 44. The shaft 51 and the insulator 31 are rotated in timed relationship. Neither the dielectric withstand capability nor the insulating properties of the insulator 31 are addressed. Although the shaft 51 is referred to as an insulated shaft, the shaft 51 is apparently metallic and no provisions are disclosed for dielectric consideration of the overall movable switch component 30 and no seals are disclosed between the insulator 31 and the shaft 51.

While these arrangements may be generally suitable for their intended purposes, none of these arrangements provides translational movement of an operating member that extends out the top of an insulating support column, that is driven below the insulating support column, and that includes metallic end portions.

SUMMARY OF THE INVENTION

Accordingly, it is a principal object of the present invention to provide an insulating support column that includes a translational operating member that extends through and outside both ends of an insulator and that also extends through one or more sealing arrangements between the operating member and the insulator, the translational operating member having a first portion of insulative material and metallic end portions; the insulating support column having a minimum overall height above a lower mounting surface, exhibiting a dielectric withstand capability that is not degraded by the presence of the operating member, and ensuring that any electrical flashover that might occur will extend and take place external to the insulator.

It is another object of the present invention to provide a sealed, insulating support column of overall minimum height above a mounting surface and having preferred dielectric withstand capabilities, the insulating support column including a translational operating member that extends through and outside both ends of an insulator, the operating member including a first, insulative portion and metallic end portions; the operating member at its upper end moving through seals in contact with the insulating portion of the operating member, and the operating member at its lower end moving through seals in contact with the metallic end portion of the operating member.

Briefly, these and other objects and advantages of the present invention are efficiently achieved by providing an insulating support column for driving interrupting units and including an insulator having a longitudinal bore extending therethrough, a translational operating member extending through and outside of both ends of the insulator, and sealing arrangements between the operating member and the insulator to retain insulating material within the insulator and to seal the bore from the external environment. The insulating support column is disposed substantially vertically during operation to drive the interrupting unit. The operating member includes a first portion of insulative material and metallic portions that are affixed at each end of the first portion. The lower metallic end portion of the operating member includes a connector that is driven by a power train and the upper metallic end portion includes a connector that is connected to drive an interrupting unit. An end fitting is affixed to each end of the insulator. Each of the end fittings includes a central bore and a sealing arrangement within the bore. The upper sealing arrangement operates with respect to the first, insulative portion of the operating member and the lower sealing arrangement operates with respect to the lower metallic portion. The lower sealing arrangement is arranged with respect to the mounting surface such that the lower metallic end portion of the operating member does not extend into the insulator beyond the end fitting. The dielectric withstand capability of the insulating support column is not reduced by the presence of the operating member for any position of the operating member along its translational path. Accordingly, if excessive voltage should cause an electrical discharge to occur between the end fittings of the insulator, the flashover will take place external to the insulator.

BRIEF DESCRIPTION OF THE DRAWING

The invention both as to its organization and method of operation, together with further objects and advantages thereof, will best be understood by reference to the specification taken in conjunction with the accompanying drawing in which.

DETAILED DESCRIPTION

Figure 1:
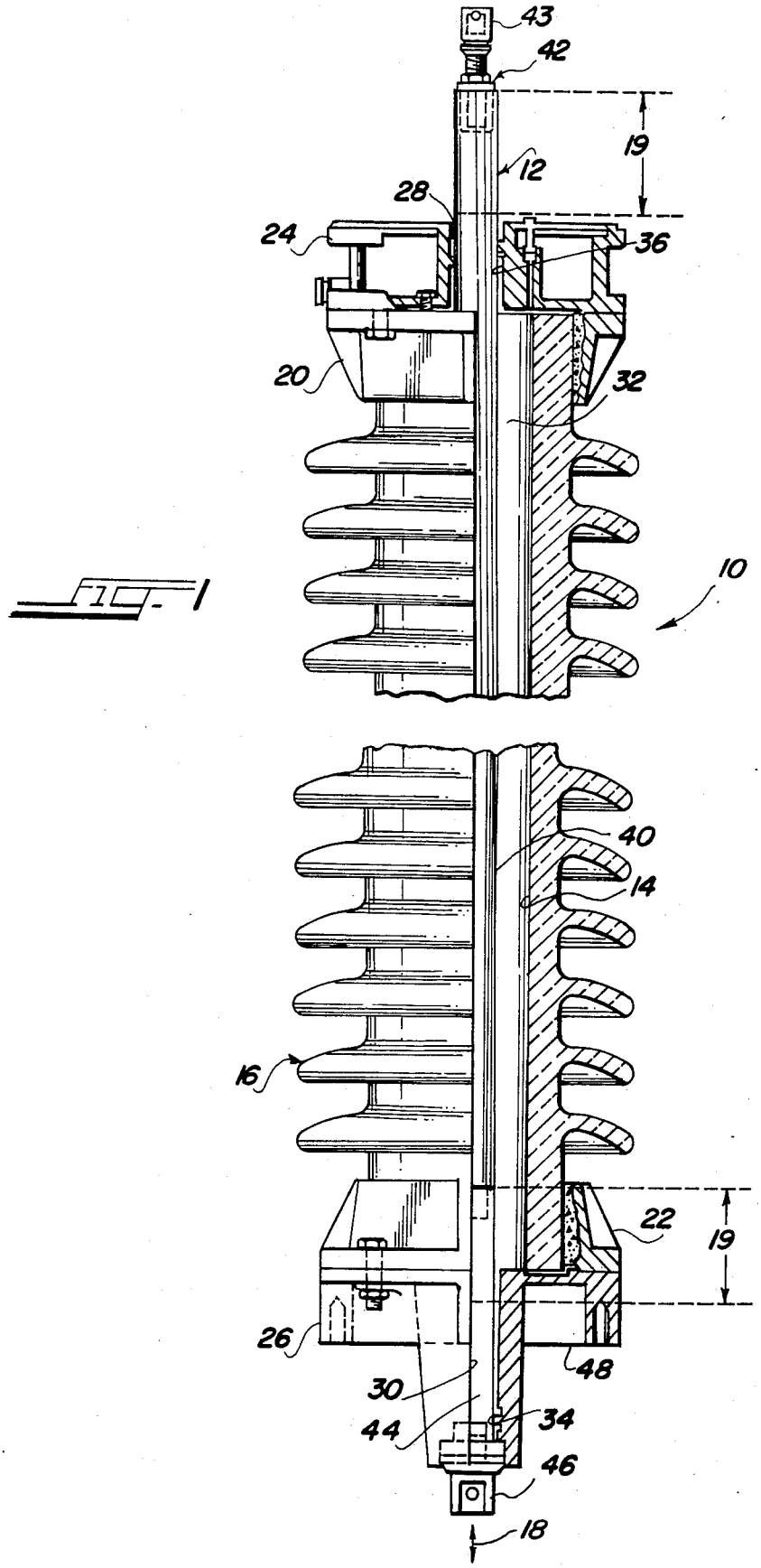
FIG. 1 is an elevational view partly in section of the insulating support column of the present invention.

Referring now to FIG. 1, the insulating support column 10 of the present invention includes an elongated operating member 12 that is disposed through a longitudinally extending bore 14 of an insulator 16 for translation or movement along a predetermined path, generally referred to at 18. The path 18 may also be referred to as a stroke, the extent of the stroke being illustrated at 19. The operating member 12 also extends out both ends of the insulator 16. An upper flange 20 is affixed to the upper end of the insulator 16 and a lower flange 22 is affixed to the lower end of the insulator 16. An upper end-fitting 24 is affixed to the upper flange 20 and a lower end-fitting 26 is affixed to the lower flange 22. The upper and lower end-fittings 24 and 26 which may also be referred to as seal housings include respective bores 28,30 for passage of the operating member 12. The lower end-fitting 26 includes suitable seals and bushings at 34 to guide the operating member 12, to seal the bore 14 from the external environment, and to prevent the leakage of insulating material or fluid from the column; the insulating material being referred to at 32 within the bore 14. The upper end-fitting 24 also includes suitable seals and bushings at 36 to guide the operating member 12 and to provide a seal around the operating member 12. In a preferred arrangement, the upper and lower flanges 20 and 22 and the upper and lower end-fittings 24 and 26 are fabricated from metal to provide the desired strength. In a preferred embodiment, the upper end-fitting 24 includes an aerator of the type disclosed in U.S. Pat. No. 3,696,729. In a specific embodiment, the end-fitting and the flange are provided as a single component.

The operating member 12 includes a first portion 40 fabricated from an insulative material such as glass-reinforced polyester. In specific embodiments, the first portion 40 is either tubular or is a solid rod. The operating member 12 also includes an upper portion 42 fabricated from metal and attached to the upper end of the first portion 40. The operating member 12 also includes a lower portion 44 fabricated from metal and attached to the lower end of the first portion 40. The upper portion 42 includes a connector 43 and the lower portion 44 includes a connector 46. In a specific embodiment, the metal portion 42 is secured by threading engagement into the first portion 40. Similarly, in a specific embodiment, the lower portion 44 is secured to the first portion 40 by threading engagement of the first portion 40 between the lower portion 44.

With the insulating support column 10 mounted vertically, as shown in FIG. 1, gravity also acts on the insulating material 32 between the seals at 34 and the operating member 12. Thus, the seal at the lower end of the insulating support column 10 must provide the necessary sealing characteristics in both a dynamic and static sense. The seal at the upper end of the insulating support column 10 as defined between the seals at 36 and the operating member 12 is less critical than the seal at the lower end of the insulating support column 10 and is required only to present the loss of insulating material 32 during shipment or storage as well as to seal the bore 14 from the external environment; the upper seal does not have any stringent, critical dynamic or static requirements during the actual service and operation of the insulating support column 10.

The lower portion 44 of the operating member 12 is in contact with the seals at 34 throughout the predetermined path and is required to present a smooth and accurate surface for engagement with the seals at 34 to provide effective, desired sealing. For uses such as those discussed in the aforementioned co-pending applications, the operating member 12 is subjected to suddenly applied tension and compression loads and reciprocates through a definite stroke or predetermined path of travel as indicated at 18. The connectors 43 and 46 are desirable and necessary for connection to driving and driven members. For example, the lower connector 46 is driven over the translational path 18 by connection to a power train and the upper connector 43 is connected to drive an interrupter operator member of an interrupting unit as discussed in more detail in co-pending application Ser. Nos. 721,616 now U.S. Pat. No. 4,596,906 Dand 721,614, filed on Apr. 10, 1985 in the names of Chabala, et al, to which reference may be made. Additionally, the insulating material 32 that is preferred for various uses of the insulating support column 10 is disclosed and claimed in co-pending application Ser. No. 721,615, filed on Apr. 10, 1985 in the names of Chabala, et al, to which reference may be made.

Since the insulating support column 10 serves as an insulator in its various applications in circuit protection device configurations, the insulating support column 10 must meet dielectric requirements including impulse voltage ratings and 60 Hz voltage withstand capabilities; the magnitudes of which depend on the voltage ratings of the specific configuration. In various circuit protection device configurations in which the insulating support column finds application and use, it is desirable to minimize the overall height of the insulating support column 10 above a mounting surface 48 of the lower end-fitting 26 and also to approximate the height of standard insulators of corresponding rated voltage. Accordingly, it is desirable to minimize the overall height of the insulating support column 10 without reducing or degrading the dielectric withstand capability of the insulating support column 10 due to the presence and translation of the operating member 12 along with any metallic portions or connectors of the operating member 12. Accordingly, any flashover induced by various testing or abnormally high service voltages, if such should occur, should take place outside the insulator 16. Thus, it is desirable to avoid encroachment by the metal portions of the operating member 12 into the dielectric gap of the insulating support column 10 such that movement of the operating member 12 over the path 18 does not degrade the dielectric withstand capability of the assembled insulating support column 10.

Figures 2, 3, 4, 5:
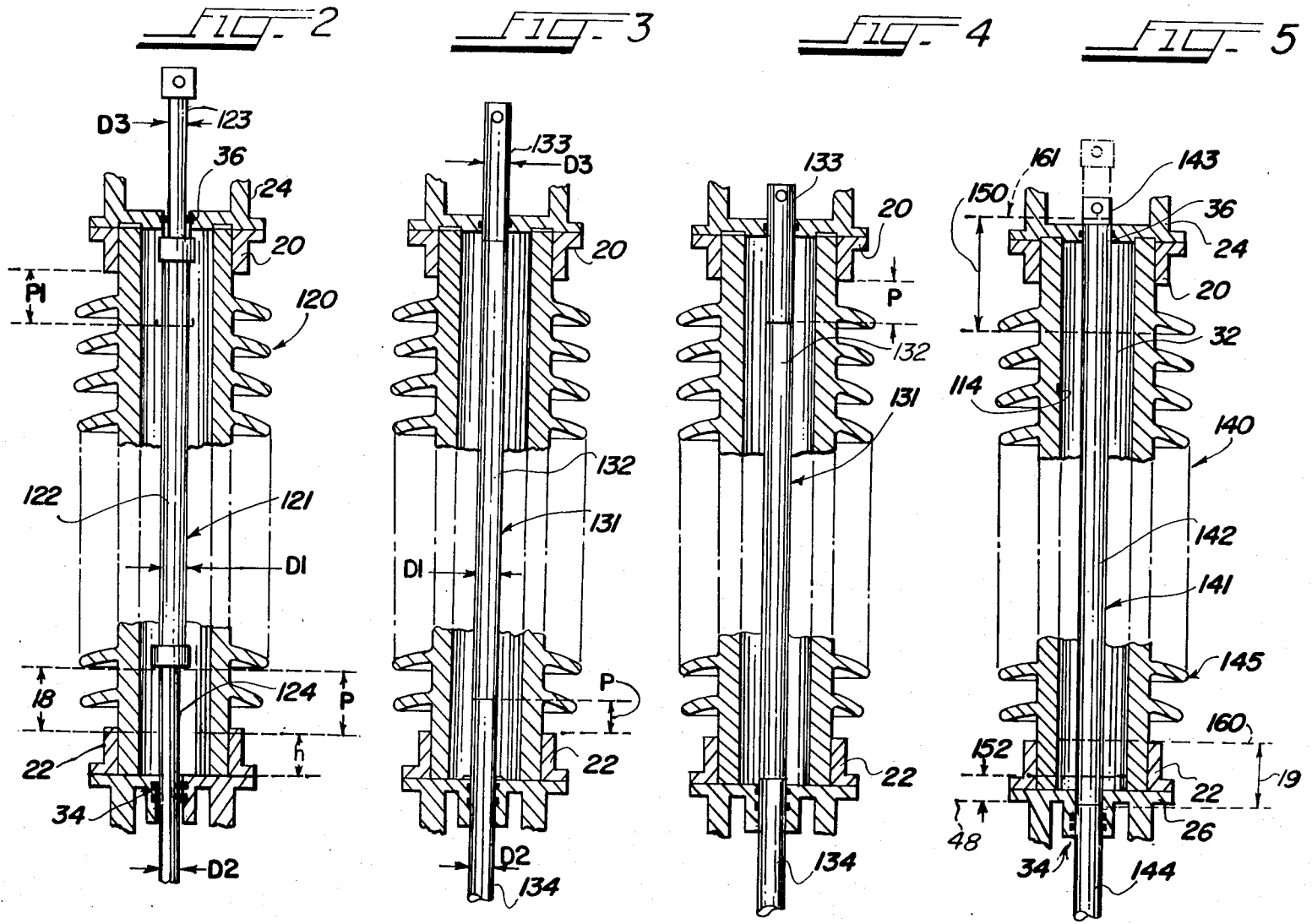
FIGS. 2–4 are diagramatic representations of insulating support columns of various configurations to illustrate the considerations that are addressed by the prevent invention.
FIG. 5 is a diagramatic representation of the insulating support column of the present invention for comparison with the arrangements of FIGS. 2–4.

Referring now to FIG. 2, graphically depicted is an insulating support column 120 having a different configuration than that of the insulating support column 10 of the present invention as illustrated in FIG. 1. In FIG. 2, the operating member 121 includes first portion 122 having a diameter D1 that is selected for buckling strength. The upper and lower metallic portions 123 and 124 are fabricated and selected for adequate strength and simple mechanical considerations with respective dimensions D3 and D2 which are significantly less than D1. When the operating member 121 is at the uppermost position of its translations path as shown in FIG. 2, the dimension P defines the penetration into the column of the lower metallic portion 124 beyond the height H of the lower flange 22. Similarly, P′ represents the penetration into the column of the upper metallic portion 123 when the operating member 121 is moved to the lowermost position of its translational travel.

In FIG. 3, there is illustrated an operating member 131 having metallic portions 133 and 134 of similar lengths to those of FIG. 2, but of equal diameter to the first, central section 132 of the operating member 131 such that D1=D2=D3. The uniform diameter of the operating member 131 is desirable to prevent churning action of the insulating material within the column which may be caused by the translational movement of an operating member that has a non-uniform diameter such as the operating member 121 of FIG. 2. However, the metallic portions 133 and 134 penetrate within the column beyond the upper and lower flanges to the same extent as shown in FIG. 2; the arrangement in FIG. 3 being illustrated with the operating member 131 at the uppermost point of travel of its translational movement. In FIG. 4, the position of the operating member 131 is illustrated at the lowest position with the maximum penetration of the portion 133 within the column. With the arrangements of FIGS. 2–4, the axial positioning of the metallic end portions of the operating member beyond the flanges is undesirable in that any electrical flashovers that are induced might not be constrained to take place external to the insulator. For example, internal dielectric breakdown or flashover can permanently damge or degrade the insulating material 32 and the operating member 12, and may cause incidental degradation or reduction of the withstand capability.

Considering the features of the present invention of the insulating support column 10 of FIG. 1 and referring now additionally to FIG. 5, the lengths of the metallic end portions 143,144 of the operating member 141 are limited so as not to extend beyond the end flanges and into the insulator 145 to ensure that any flashover that occurs will take place external to the insulator 145. The insulating support column 140 of FIG. 5 and the insulating support column 10 of FIG. 1 achieve the features of the present invention by providing a minimal-length, metallic upper portion 142 and a metallic lower portion 144 that does not extend into the insulator 145 beyond the depth of the lower flange 22 such that the first portion 143 of the operating member 141 that is fabricated from insulative material is greater in length as compared to that of the operating members of FIGS. 2–4; the increase in length being defined as depicted by the dimension 150 at the upper end and by the dimension 152 at the lower end of the column 140. Accordingly, the length of the first portion 142 is at least equal to or greater in length than the sum of the separation between the upper end fitting 24 and the lower end fitting 26 and the length 19 of the stroke or predetermined path of translation.

In accordance with the present invention, the insulating portion 142 of the operating member 141 operates in the upper seals 36 of the upper end-fitting 24 such that the metallic upper portion 143 never extends beyond the flange 20 and, in fact, never even extends to the beginning of the flange 20 since the portion 143 does not extend beyond the seals 36 at any point of the translational path (i.e. the upper portion 143 never moves below the position 161 of FIG. 5). Further, the metallic, upper portion 143 of the operating member 141 does not degrade the dielectric withstand capability of the insulating support column 140. Similarly, the low location of the seals 34, with respect to the flange 22 and the mounting surface 48, provides for continuous engagement of the seals 34 by the metallic, lower portion 144 of the operating member 141 throughout the translational path while also eliminating any extension into the insulator 145 of the metallic, lower portion 144 above the extent of the flange 22; the farthest extension of travel of the metallic, lower portion 144 being depicted at 160. Thus, the insulating support column 140 of FIG. 5 and the insulating support column 10 of FIG. 1 provide appropriate sealing for the insulating material 32 while maintaining a desired dielectric withstand capability without degradation due to the translational operating member 141 that includes metallic end portions. Further, these desirable characteristics are achieved without an increase in the height of the insulating support column 10 above the mounting surface 48; the lower seals 34 being capable of being repositioned as shown in FIG. 5 with respect to that of the arrangements in FIGS. 2–4 while the mounting surface 48 for the insulating support column remains the same. As can be seen from FIG. 5, the seals 34 are positioned below the top end of the flange 22 by a distance that is approximately equal to the length 19 of the predetermined path.

The operating member 141 of the insulating support column 140 of FIG. 5 depicts a specific embodiment of the present invention wherein the operating member 141 includes a uniform cross section while the operating member 12 of the insulating support column 10 of FIG. 1 depicts a specific embodiment wherein the operating member 12 is of non-uniform cross section. In a specific embodiment where the end fittings 24 and 26 are insulative, the seals 34 and 36 can be positioned closer to the bore 114 but these positions must of course be consistent with the desired positions of the metallic end portions 143,144 or 42,44. While the operating member 12 of the insulating support column 10 of FIG. 1 is discussed as being capable of translation with respect to the insulator 16, in a specific embodiment, the operating member 12 is also capable of rotational movement with respect to the insulator 16 as disclosed in the aforementioned application Ser. No. 721,616, now U.S. Pat. No. 4,596,906.

While there have been illustrated and described various embodiments of the present invention, it will be apparent that various changes and modifications will occur to those skilled in the art. It is intended in the appended claims to cover all such changes and modifications as fall within the true spirit and scope of the present invention.

What is claimed and desired to be secured by Letter Patent of the United States is:

1. An insulating support column comprising:

an elongated insulator having a longitudinal bore extending therethrough;

upper and lower fittings affixed to said insulator, each of said fittings including a central bore;

an elongated operating member extending through said bore of said insulator and through said upper and lower fittings, said elongated operating member including a first portion having a predetermined length and being fabricated from insulative material, said elongated operating member further including metallic end portions affixed at the ends of said first portion, said elongated operating member being arranged for translation over a predetermined longitudinal path with respect to said insulator, said first portion of said elongated operating member being greater in length than the sum of the separation between said upper and lower fittings and the length of said predetermined longitudinal path; and a lower sealing arrangement provided within the bore of said lower fitting for cooperation with said elongated operating member, said lower sealing arrangement being carried within said bore of said lower fitting, the longitudinal positioning of said lower fitting and said elongated operating member being determined along with the length of said lower metallic end portion so that said lower sealing arrangement acts on said lower metallic end portion throughout said predetermined longitudinal path and such that the dielectric withstand capability of the insulating support column is not degraded by said elongated operating member for any position of said elongated operating member along said predetermined longitudinal path.

2. The insulating support column of claim 1 further comprising insulating material disposed within the bore of said insulator.

3. The insulating support column of claim 2 further comprising an upper sealing arrangement provided within the bore of said upper fitting for cooperation with said elongated operating member, said upper sealing arrangement and said elongated operating member being longitudinally positioned so that said upper sealing arrangement acts on said first portion of said elongated operating member throughout said predetermined longitudinal path.

4. The insulating support column of claim 3 wherein said longitudinal positioning of said upper sealing arrangement with respect to said lower fitting is the minimum distance that is consistent with the separation between said upper and lower fittings.

5. The insulating support column of claim 3 wherein said lower fitting defines a reference plane for the mounting of the insulating support column, and wherein the top of said lower sealing arrangement is longitudinally positioned below said top end of said lower fitting by a distance that is approximately equal to the length of said predetermined longitudinal path.

6. The insulating support column of claim 3 wherein said elongated operating member is longitudinally positioned in said insulator such that said lower metallic end portion of said elongated operating member does not extend into said insulator beyond the extent of said lower fitting at any point of said predetermined longitudinal path, said lower sealing arrangement being longitudinally positioned such that it is below the top end of said lower metallic end portion of said elongated operating member when said elongated operating member is at the lowermost position of said predetermined longitudinal path.

7. The insulating support column of claim 1 wherein said elongated operating member is tubular.

8. The insulating support column of claim 1 wherein said elongated operating member is a solid rod.

9. The insulating support column of claim 1 wherein the cross sections of said first portion and said lower metallic end portion of said elongated operating member are of substantially identical shape and dimensions.

10. The insulating support column of claim 1 wherein said elongated operating member extends out both ends of said insulator and said upper and lower fittings throughout said predetermined longitudinal path.

11. The insulating support column of claim 1 wherein said upper and lower fittings are metallic.

12. An insulating support column comprising:

an elongated insulator having a longitudinal bore extending therethrough;

upper and lower fittings affixed to said insulator, each of said fittings including a central bore and a sealing arrangement disposed within said bore; and an elongated operating member extending through said bore of said insulator and said bores of said upper and lower fittings, said elongated operating member being arranged for translation over a predetermined longitudinal path with respect to said insulator, said sealing arrangements cooperating in sealing engagement with said elongated operating member throughout said predetermined longitudinal path, said elongated operating member including a first portion having a predetermined length and being fabricated from insulative material, said elongated operating member further including metallic end portions affixed at the ends of said first portion, the longitudinal position of said sealing arrangements of said upper and lower fittings and said length and longitudinal positioning of said first portion and said metallic end portions being defined such that said sealing arrangement of said upper fitting engages said first portion of said elongated operating member throughout said predetermined longitudinal path, such that said sealing arrangement of said lower fitting engages said lower metallic end portion throughout said predetermined longitudinal path, and such that said metallic end portions never extend longitudinally into said insulator past the extent of said upper and lower fittings.

13. The insulating support column of claim 12 wherein said upper and lower fittings are metallic.

* * * * *